US011274645B2

(12) United States Patent
Yamagishi

(10) Patent No.: US 11,274,645 B2
(45) Date of Patent: Mar. 15, 2022

(54) CIRCUIT AND METHOD FOR A KICKBACK-LIMITED SOFT SHUTDOWN OF A COIL

(71) Applicant: SEMICONDUCTOR COMPONENTS INDUSTRIES, LLC, Phoenix, AZ (US)

(72) Inventor: Mikio Yamagishi, Fukaya (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 226 days.

(21) Appl. No.: 16/674,560

(22) Filed: Nov. 5, 2019

(65) Prior Publication Data

US 2021/0108605 A1 Apr. 15, 2021

Related U.S. Application Data

(60) Provisional application No. 62/915,125, filed on Oct. 15, 2019.

(51) Int. Cl.

| | |
|---|---|
| ***F02P 3/055*** | (2006.01) |
| ***F02P 3/05*** | (2006.01) |
| ***H01F 38/12*** | (2006.01) |

(52) U.S. Cl.

CPC ..... *F02P 3/0552* (2013.01); *F02P 3/05* (2013.01); *F02P 3/051* (2013.01); *H01F 38/12* (2013.01)

(58) Field of Classification Search

CPC ..... F02P 3/045; F02P 3/0453; F02P 3/0456; F02P 3/05; F02P 3/051; F02P 3/053; F02P 3/055; F02P 3/0552; F02P 3/0554; F02P 3/0556; F02P 3/0558; F02P 9/002;

(Continued)

(56) References Cited

U.S. PATENT DOCUMENTS 4,275,701 A * 6/1981 Arguello ..... F02P 3/0435 123/146.5 A
5,127,388 A * 7/1992 Cicalese ..... F02P 3/053 123/644

(Continued)

FOREIGN PATENT DOCUMENTS

JP 2008045514 A * 2/2008
JP 2010059798 A * 3/2010

(Continued)

*Primary Examiner* — John M Zaleskas
(74) *Attorney, Agent, or Firm* — Brake Hughes Bellermann LLP

(57) ABSTRACT

A circuit configured to control a switching device to reduce a current in a charged coil is disclosed. The circuit is configured to monitor a kickback voltage generated by the decreasing current in the coil. The circuit is further configured to adjust a rate at which the current is reduced in order to limit the kickback voltage. Limiting the kickback voltage during shutdown can prevent a spark at a spark gap that is inductively coupled to the coil and can allow for greater flexibility in the time taken to shut down the coil without overheating components or generating an unwanted spark. Additional, limiting the kickback voltage during shutdown can allow for a pseudo ramp wave to control the circuit during the shutdown because voltage spikes cause by abrupt changes in the pseudo ramp wave are limited.

19 Claims, 10 Drawing Sheets

(58) Field of Classification Search
CPC ..... F02P 17/12; F02P 2017/121; H03K 17/0828; H03K 17/166; H03K 17/168; H01T 15/00
See application file for complete search history.

(56) References Cited

U.S. PATENT DOCUMENTS

| | | | | |
|---|---|---|---|---|
| 5,569,982 | A * | 10/1996 | Nadd | F02P 3/0552 123/645 |
| 6,257,216 | B1 * | 7/2001 | Forster | F02P 3/0435 123/652 |
| 6,336,448 | B1 * | 1/2002 | Furuhata | F02P 3/053 123/644 |
| 6,766,243 | B1 * | 7/2004 | Haussmann | F02D 41/266 123/339.11 |
| 10,968,880 | B1 * | 4/2021 | Yamagishi | F02P 3/0554 |
| 11,162,469 | B2 * | 11/2021 | Nodake | F02D 41/22 |
| 2001/0037801 | A1 * | 11/2001 | Ito | F02P 3/04 123/644 |
| 2002/0093372 | A1 * | 7/2002 | Theobald | H03K 17/168 327/478 |
| 2002/0144993 | A1 * | 10/2002 | Spampinato | H03K 17/0826 219/494 |
| 2005/0146822 | A1 * | 7/2005 | Ando | F02P 3/051 361/93.8 |
| 2005/0178372 | A1 * | 8/2005 | Kesler | F02P 3/055 123/630 |
| 2006/0022609 | A1 * | 2/2006 | Yukutake | F02P 3/0552 315/209 T |
| 2006/0077000 | A1 * | 4/2006 | Goudo | F02P 3/051 327/434 |
| 2006/0213489 | A1 * | 9/2006 | Moran | F02P 3/051 123/651 |
| 2009/0071422 | A1 * | 3/2009 | Young | F02P 3/0554 123/90.11 |
| 2011/0134581 | A1 * | 6/2011 | Godo | F02P 3/0554 361/263 |
| 2011/0141651 | A1 * | 6/2011 | Godo | F23Q 3/004 361/263 |
| 2012/0033341 | A1 * | 2/2012 | Miyazawa | F23Q 3/004 361/253 |
| 2012/0085327 | A1 * | 4/2012 | Mizukami | F02P 3/0442 123/626 |
| 2012/0215431 | A1 * | 8/2012 | Miyazawa | F02P 3/0552 701/115 |
| 2013/0241609 | A1 * | 9/2013 | Miyazawa | H03K 3/57 327/142 |
| 2013/0279067 | A1 * | 10/2013 | Yamada | F02P 3/04 361/253 |
| 2013/0335864 | A1 * | 12/2013 | Trecarichi | H03K 17/166 361/36 |
| 2016/0134085 | A1 * | 5/2016 | Obe | F02P 3/0453 123/406.12 |
| 2016/0265501 | A1 * | 9/2016 | Miyazawa | H03K 17/567 |
| 2017/0294907 | A1 * | 10/2017 | Volke | H03K 17/082 |
| 2017/0338737 | A1 * | 11/2017 | Kohama | F02P 3/0552 |
| 2018/0062499 | A1 * | 3/2018 | Yamamoto | F02P 3/0435 |
| 2018/0309433 | A1 * | 10/2018 | Volke | H03K 17/166 |
| 2019/0028096 | A1 * | 1/2019 | Lee | F02P 3/053 |
| 2019/0136820 | A1 * | 5/2019 | Yamagishi | F02P 9/002 |
| 2019/0190238 | A1 * | 6/2019 | Yamamoto | F02P 3/055 |
| 2020/0080528 | A1 * | 3/2020 | Nodake | H03K 17/168 |
| 2020/0116118 | A1 * | 4/2020 | Yamagishi | F02P 3/0435 |
| 2020/0232437 | A1 * | 7/2020 | Yamagishi | F02P 3/053 |
| 2020/0240385 | A1 * | 7/2020 | Ueno | F02P 3/0442 |
| 2020/0340441 | A1 * | 10/2020 | Nodake | H03K 17/0828 |

FOREIGN PATENT DOCUMENTS

| | | | |
|---|---|---|---|
| JP | 2014140280 | A * | 7/2014 |
| JP | 2016089674 | A * | 5/2016 |
| JP | 2017207012 | A * | 11/2017 |

* cited by examiner

CIRCUIT AND METHOD FOR A KICKBACK-LIMITED SOFT SHUTDOWN OF A COIL

CROSS-REFERENCE TO RELATED APPLICATIONS

This application claims the benefit of U.S. Provisional Patent Application No. 62/915,125, filed on Oct. 15, 2019, the entire contents of which is incorporated herein by reference.

FIELD OF THE DISCLOSURE

The present disclosure relates to ignition systems and more specifically to a circuit and method for limiting a kickback voltage to prevent a spark when discharging a charged coil according to a soft shutdown (SSD) profile.

BACKGROUND

An ignition system includes circuitry to create a spark to ignite combustion in a combustion engine (e.g., of a vehicle). The circuitry includes a primary coil in series between a voltage source (e.g., a battery) and a switching device coupled to a ground. The primary coil is inductively coupled to a secondary coil that is in series with a spark gap. When the switching device is configured to conduct (i.e., is turned ON), the primary coil is charged by a coil current flowing from the voltage source and through the primary coil and the switching device to the ground. After the coil is charged, the switching device may be configured (i.e., turned OFF) to block the coil current. The abrupt change in the coil current creates a large voltage across the primary coil as the primary coil begins to discharge. This large voltage is transformed by a windings-ratio between the primary and secondary coil. The transformed voltage is sufficiently high to generate a spark at the spark gap.

The electronic processes of a vehicle can be monitored and controlled by an engine control unit (ECU). For example, the ECU may generate a first signal (i.e., a rising edge) to begin charging the coil and a second signal (e.g., a falling edge) to trigger the spark. The period between the first signal and the second signal is known as a dwell period. If the dwell period is too long (i.e., over-dwell), overheating of the circuitry (e.g., the coil, the switching device) may occur. Accordingly, an over-dwell may trigger a discharge of the coil to prevent damage (e.g., thermal damage).

Because the timing of the triggered discharge may not be aligned with the timing of the combustion engine (i.e., engine), circuitry can be configured to discharge the coil gradually to prevent a spark. This gradual discharge of the coil is known as a soft shutdown (SSD). During a soft shutdown, the coil current in the primary coil is gradually reduced to minimize a kickback voltage created by the changing current (i.e., $V=L \cdot dI/dt$). It is in this context that implementations of the disclosure arise.

SUMMARY

In at least one aspect, the present disclosure generally describes an ignition system. The ignition system includes an ignition coil conducting a coil current. The ignition system further includes a switching device (e.g., an IGBT) coupled to the ignition coil at a collector terminal and controllable at a gate terminal to adjust the coil current. The ignition system further includes a current control circuit that is configured to output a signal at the gate terminal to reduce the coil current according to a soft shutdown profile. The current-control circuit includes a kickback voltage limiter that is configured to monitor a collector voltage at the collector terminal and to adjust the soft shutdown profile according to the collector voltage to limit a kickback voltage.

In another aspect, the present disclosure generally describes a method for shutting down a coil current in a coil. The method includes controlling a switching device to reduce the coil current in the coil according to a soft shutdown profile. The method further includes monitoring a voltage at a terminal of the switching device and adjusting the soft shutdown profile according to the voltage in order to limit a kickback voltage generating by the coil.

In another aspect, the present disclosure generally describes current-control circuit. The current-control circuit includes a coil-current sensor that is configured to sense a coil current flowing through a switching device that is in series with a coil. The current-control circuit further includes a kickback voltage limiter that is configured to sense a collector voltage at a terminal of the switching device, which is directly coupled to the coil. The kickback voltage limiter is further configured to compare the collector voltage to a voltage-limit threshold. The current-control circuit further includes a soft shutdown circuit that is configured to receive a ramp signal and to reduce the coil current based on the ramp signal and the sensed coil current. The soft shutdown circuit is further configured to decrease a rate at which the coil current is reduced when the collector voltage exceeds the voltage-limit threshold.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

When a current in a charged coil is shutdown, a kickback voltage is generated by a collapsing magnetic field associated with the charged coil. The amplitude of the kickback voltage corresponds to the rate that the current is shutdown. A large kickback voltage can produce a spark at a spark gap inductively coupled to the charged coil. To prevent a spark, the current can be shutdown gradually, and the more gradually the current is shutdown the greater margin of protection against an unwanted spark is provided. A gradual shutdown, however, can prolong the heating of components by the current. To make matters worse, a gradually shutdown may be triggered in order to prevent overheating these components in the first place. Accordingly, it may be simultaneously desirable to (i) shutdown a current in a charged coil gradually to prevent an unwanted spark and (ii) minimize the time it takes to gradually shutdown the current to minimize heating. The disclosed system, circuits, and methods address both of these aspects by limiting the kickback voltage during the gradual shutdown of the current in the charged coil.

In one aspect, the present disclosure describes a circuit configured to control a switching device to reduce a current in a charged coil while monitoring a kickback voltage generated by the decreasing current in the coil. The circuit is further configured to adjust a rate at which the current is reduced in order to limit the kickback voltage. Limiting the kickback voltage during shutdown can prevent a spark at a spark gap that is inductively coupled to the coil and can allow for greater flexibility in the time taken to shut down the coil without overheating components or generating an unwanted spark. Additional, limiting the kickback voltage during shutdown can allow for a pseudo ramp wave to control the circuit during the shutdown because voltage spikes cause by abrupt changes in the pseudo ramp wave are limited.

Figure 1:
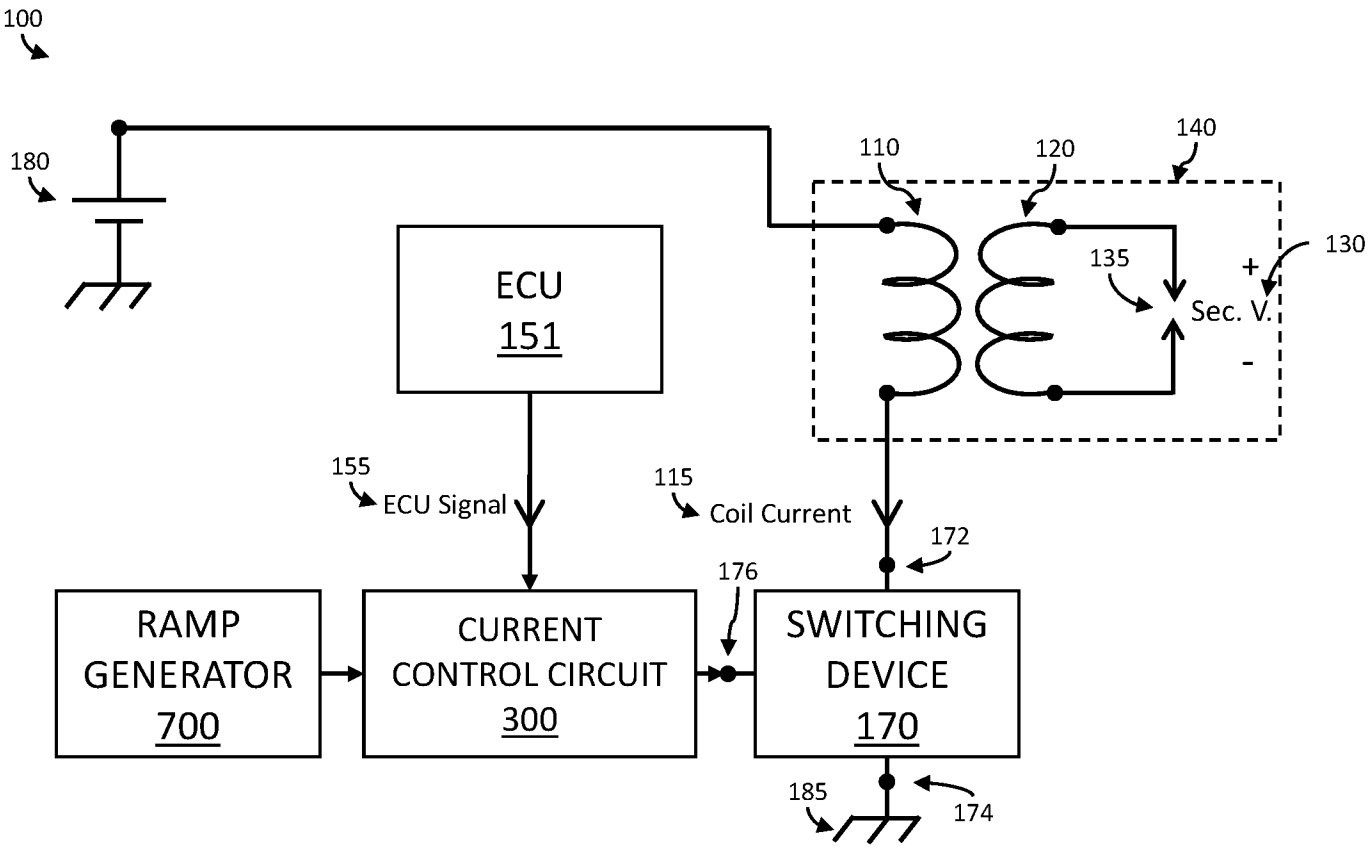
FIG. 1 is a block diagram that schematically depicts an ignition system.

FIG. 1 is a block diagram that schematically depicts an ignition system. The ignition system 100 includes a voltage source (e.g., battery) 180 coupled to an ignition coil 140. The ignition coil includes a primary winding (i.e., primary coil) 110 and a secondary winding (i.e., secondary coil) 120. The secondary coil 120 is coupled to a spark gap 135. A voltage across the primary coil is inductively coupled and stepped-up (i.e., transformed) by a windings-ratio to produce a secondary voltage 130 across the spark gap 135.

The primary coil 110 may be charged by a coil current 115 flowing from a voltage source (e.g., a battery) 180 through the primary coil. The flow of the coil current may be controlled by a switching device 170 coupled between the primary coil 110 and a ground 185. When the switching device 170 is turned ON (i.e., conducts) the coil current 115 can flow from the voltage source 180 to the ground 185. The switching device 170 may be a transistor, such as an insulated gate bipolar transistor (IGBT). While not limited to this device, the disclosure will refer to switching device and IGBT interchangeably.

The IGBT 170 may have a collector terminal 172 coupled to the primary coil 110 and an emitter terminal 174 coupled to the ground 185. Conduction between the collector terminal 172 and the emitter terminal 174 can be controlled by a signal (e.g., a voltage) at a gate terminal 176 of the IGBT 170. Accordingly, the gate terminal 176 of the IGBT 170 may be coupled to a coil current-control circuit (i.e., current-control circuit) 300 that is configured to control the coil current 115 by adjusting the conduction of the IGBT 170.

The current-control circuit 300 may be configured to control the coil current to charge the primary coil and to discharge the primary coil. The current-control circuit is configured to discharge the primary coil abruptly (i.e., a hard shutdown (HSD)) or gradually (i.e. a soft shutdown (SSD). Signals from an engine control unit (ECU) 151, may determine the timing and the function (e.g., type of discharge) of the current-control circuit 300. Additionally, signals from sensors and/or timers may detect an undesirable condition in the engine. For example, the undesirable conditions may include (but are not limited to) over dwell, and/or over temperature conditions. The operation described above may be further understood by considering example signals associated with a possible implementation of the ignition system of FIG. 1.

Figure 2:
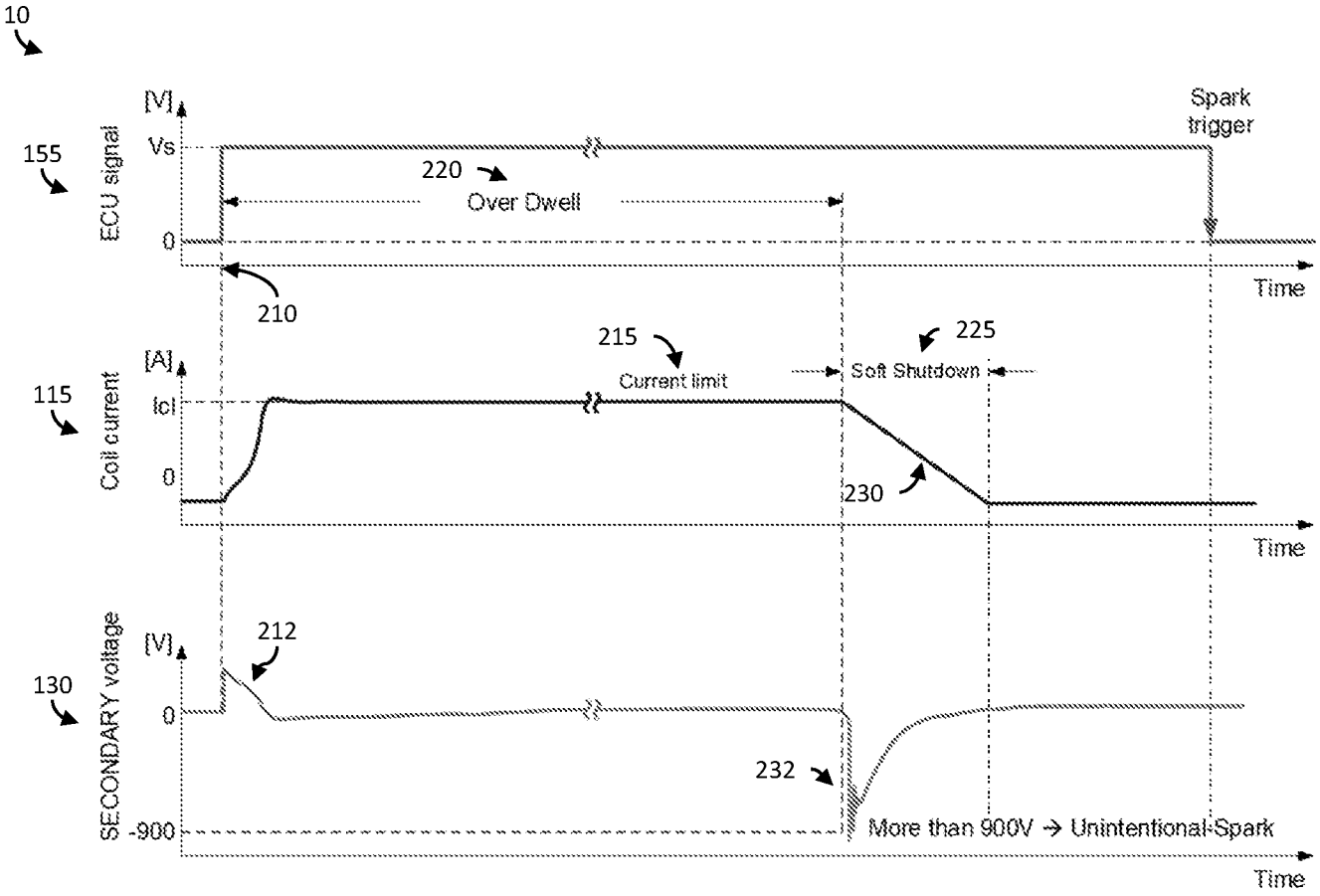
FIG. 2 are time-based graphs of signals corresponding to ignition system in FIG. 1.

FIG. 2 includes graphs of signals corresponding to the ignition system 100 of FIG. 1. The signals are all plotted versus the same time period/scale. The example signals include an ECU signal 155, a coil current 115, and a secondary (coil) voltage 130. At a first time 210, the ECU signal 155 (i.e., a rising edge) triggers the current-control circuit 300 to configure the IGBT in an ON condition (i.e., high conduction) so that coil current 115 can begin to flow. The coil current increases as the primary coil 110 is charged and this increase produces a positive secondary voltage 212. After the charging period, the coil current reaches a current limit 215 and ceases to change significantly. In this state, a hard shutdown of the coil current 115 (not shown) could trigger a spark at the spark gap. If the abrupt shutdown does not occur (e.g., within an over dwell period 220), however, over-heating of the primary coil 110 and/or the IGBT 170 may occur. To prevent damage of these components, a soft shutdown of the coil current can be controlled by the ramp generator 700, which produces a signal (i.e., ramp wave, ramp signal) to configure the current-control circuit to gradually reduce of the coil current according to an SSD profile 230.

The current gradually decreases according to the SSD profile 230 from the current limit 215 to a lower (e.g., zero) current level. The gradual change of the primary current still generates negative secondary voltage (i.e. a kickback voltage) 232. The amplitude of the kickback voltage corresponds to a rate (i.e. slope) of the SSD profile. By keeping the slope of the SSD profile below a (predetermined) limit, the kickback voltage 232 can be kept below a break-down (i.e., spark) level (e.g., 900 volts) and no unintentional spark is generated during the soft shutdown period.

The slope of the SSD profile 230 defines an SSD period 225. A longer SSD period 225 results in a smaller kickback voltage 232 (i.e., than a shorter SSD period). Extending the SSD period 225, however, corresponds to additional heating that the primary coil 110 and/or the IGBT 170 must endure. Accordingly, it may be simultaneously desirable to (i) increase the SSD period 225 to reduce a kickback voltage (i.e., prevent a spark) and (ii) decrease the SSD period 225 to prevent excessively heating components (e.g., IGBT, primary coil, etc.). The disclosed circuits and methods can limit the kickback voltage to prevent a spark during a soft shutdown. The spark prevention facilitates a reduction of the SSD period (i.e., an increase in a coil-discharge rate) to minimize heating, and more generally, increases a range of possible safe coil discharge rates. The disclosed circuits and methods are automatically configured limit the kickback voltage in during an SSD and to not limit the kickback voltage during an HSD. In other words, the disclosed circuits and methods require no special monitoring (e.g. of an SSD or HSD status) to carry out the automatic limiting/not-limiting.

Figure 3:
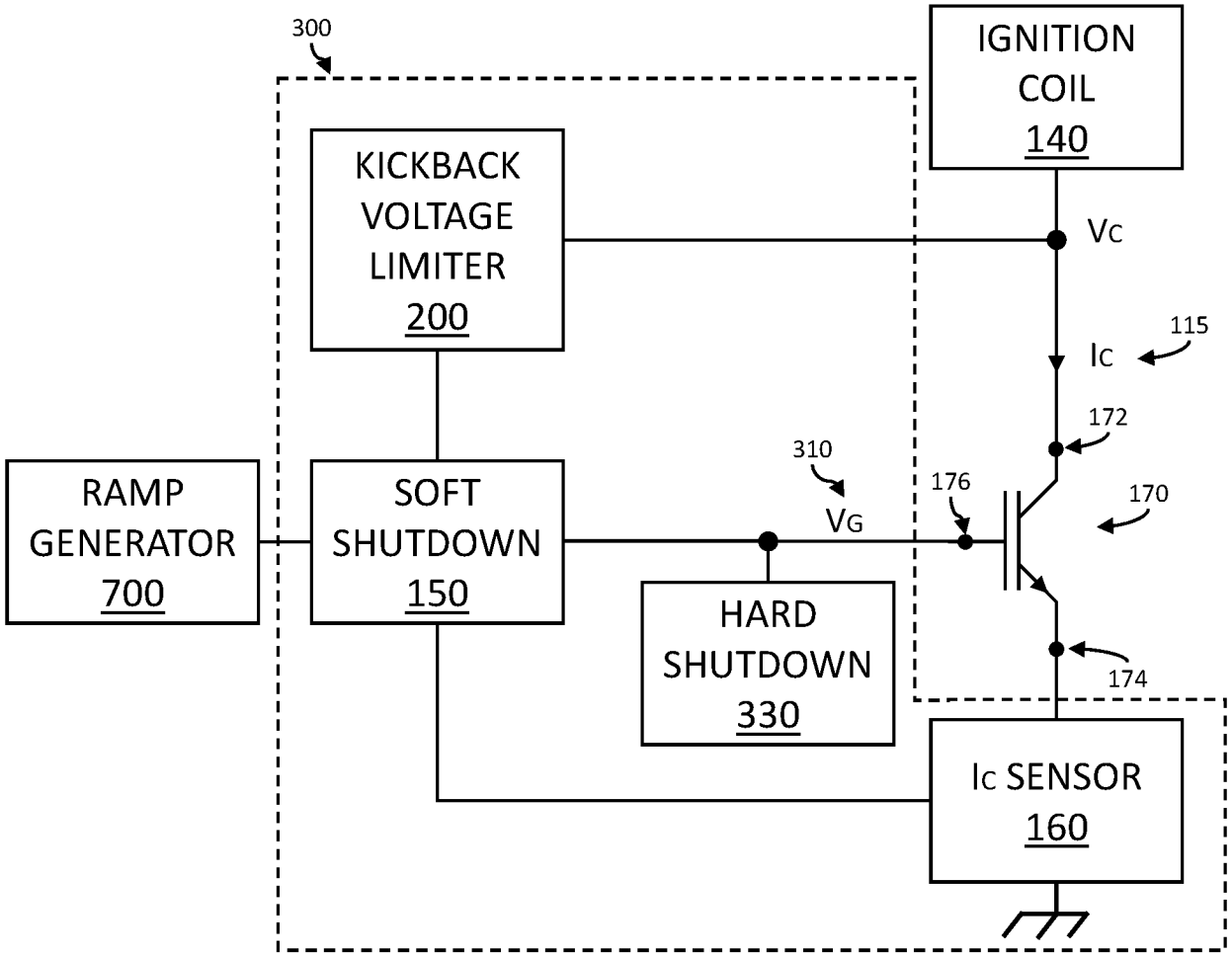
FIG. 3 is a block diagram an ignition system having a current-control circuit configured to limit a kickback voltage during soft-shutdown according to an implementation of the present disclosure.

FIG. 3 is a block diagram that schematically depicts a portion of an ignition system configured for a kickback-limited soft shutdown. The current-control circuit 300 of the ignition system includes a hard shutdown circuit 330. When triggered, the hard shutdown circuit 330 may configure (i.e., turn OFF) the IGBT 170 to abruptly block the coil current ($I_C$) 115. The abrupt change in the coil current can generate a kickback voltage 232 that is large enough to breakdown the spark gap in an ignition coil 140 (i.e., generate a spark).

The current-control circuit 300 of the ignition system 100 further includes a soft shutdown circuit 150 and a ramp generator 700. When triggered a signal from the ramp generator 700 is generated. The signal from the ramp generator may configure the soft shutdown circuit 150 to output a gate voltage ($V_G$) according to an SSD profile. The $V_G$ can configure the IGBT 170 to gradually lower the coil current ($I_C$) 115 according to an SSD profile.

The soft shutdown circuit 150 (SSD circuit) and the hard shutdown circuit 330 (HSD circuit) are both coupled to the gate terminal 176 of the IGBT but through the use of ECU signals, logic, circuit topology, and/or different device types the SSD circuit and the HSD circuit can be configured to operate independently of one another. For example, the HSD circuit 330 may be decoupled from the gate terminal 176 of the IGBT during while the SSD circuit 150 controls the IGBT.

The current-control circuit 300 further include a kickback voltage limiter circuit (i.e., kickback voltage limiter) 200. The kickback voltage limiter 200 can be coupled between a collector terminal 172 of the IGBT 170 and the soft shutdown 150. The kickback voltage limiter 200 can be configured to adjust an output of the soft shutdown circuit 150 when a voltage at a collector terminal 172 (i.e., a collector voltage, $V_C$) exceeds a voltage-limit threshold (i.e., threshold, reference level, etc.). In particular, during a soft shutdown, a voltage at a gate terminal 176 (i.e., a gate voltage, $V_G$ 310) can be adjusted to configure the IGBT 170 to increase the coil current 115 ($I_C$) in proportion to an excess collector voltage (i.e., the difference between the collector voltage and the threshold voltage). As a result, the collector voltage can be limited to a clamped level. Because the collector voltage ($V_C$) corresponds to the primary coil voltage, which in turn corresponds to the secondary voltage, the secondary voltage 130 can be clamped at a level below a breakdown voltage. Increasing the coil current to clamp the collector voltage may change (e.g., reduce) a slope of the SSD profile 230 (i.e. increase an SSD period) but because the change (e.g., reduction) is only in proportion to the excess collector voltage, any additional heating that results can be relatively small.

An ignition system including a current-control circuit with a kickback-limited soft shutdown may be desirable for a variety of reasons. Kickback limiting can prevent an unintended spark, which lead to undesirable (e.g., damaging) effects on a combustion engine. Kickback limiting may allow for more variation in the SSD profiles that can be used for a soft shutdown because the kickback voltage can be limited to the same level for shorter and longer SSD periods alike. Accordingly, in some implementations, an SSD period can be reduced to periods shorter than without kickback limiting. Reducing the SSD period may result in a reduction in the overall heating of components, such as the ignition coil and/or the IGBT. Kickback limiting may reduce (i.e. limit, clamp) other transient spikes in the circuitry associated with the ignition system, and the reduction in transient spikes (i.e., transients) may allow for new circuits, devices, or modes of operation that would otherwise be problematic because of transients.

Figure 4:
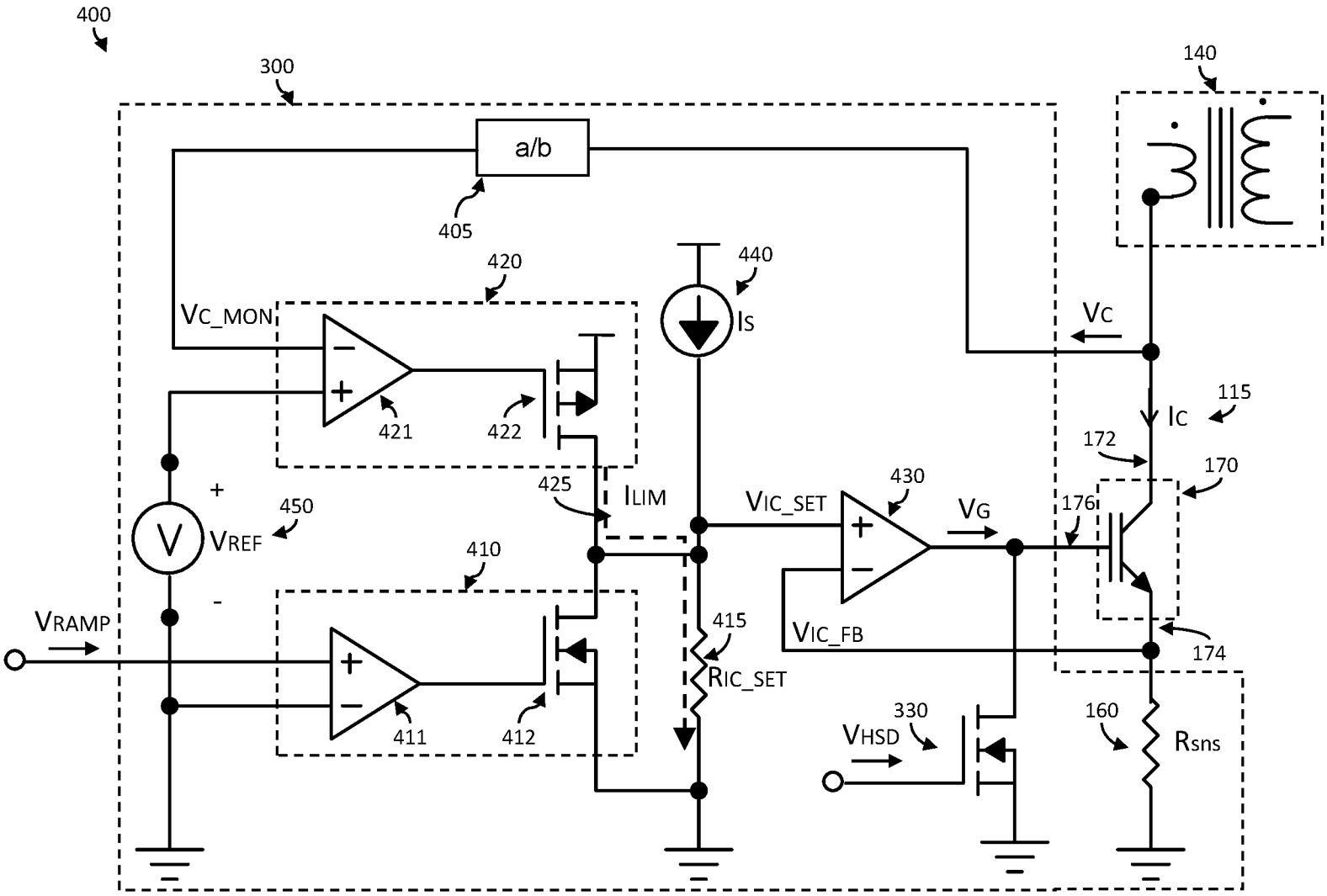
FIG. 4 is a schematic of an ignition system having a kickback-limited soft-shutdown circuit according to an implementation of the present disclosure.

FIG. 4 is a schematic of an ignition system having a kickback-limited soft shutdown circuit according to an implementation of the present disclosure. The ignition system 400 includes an ignition coil 140 coupled to an IGBT 170. A coil current ($I_C$) 115 of the ignition coil 140 can be controlled by adjusting a conduction (i.e., operating point) of the IGBT 170. Accordingly, the ignition system includes a current-control circuit 300 configured to control the operation of the IGBT. The current-control circuit 300 is coupled to a collector terminal 172, a gate terminal 176, and an emitter terminal 174 of the IGBT 170. Additionally, the current-control circuit 300 is configured to receive a signal ($V_{RAMP}$) from a ramp generator (not shown).

The current-control circuit 300 includes circuitry to control the operating point of the IGBT 170 so that the ignition coil 140 can be charged and discharged. The ignition coil 140, may be discharged abruptly or gradually.

For an abrupt discharge (i.e., a hard shutdown), the current-control circuit 300 includes a hard shutdown (HSD) circuit (i.e., transistor) 330 coupled directly to the gate terminal 176 of the IGBT 170. The HSD transistor 330 can be n-type enhancement-mode metal-oxide semiconductor field-effect transistor (MOSFET) or any other type transistor that can be controlled by a hard shutdown signal, $V_{HSD}$, (e.g., from the ECU) to pull the gate terminal 176 of the IGBT down to a ground in a first (e.g., the ON) state and to decouple the ground from the rest of the current-control circuit in a second (e.g. OFF) state. When the gate terminal 176 is grounded, the IGBT 170 is placed in an OFF state and the coil current ($I_C$) is blocked (i.e., shut off). The coil current is reduced (i.e., decreased) according to a hard shutdown profile.

For a gradual discharge (i.e., a soft shutdown), a feedback control loop may be used to regulate the coil current to a reference (i.e., set) level that is gradually reduced. The feedback control loop includes an error amplifier 430 that outputs a gate voltage ($V_G$) to control the operating point (i.e., the conduction) of the IGBT 170. The output of the error amplifier (i.e., $V_G$) corresponds to a difference between a coil-current set voltage ($V_{IC_SET}$) and a coil-current feedback voltage ($V_{IC_FB}$). The IGBT operating point is adjusted by the gate voltage so that the difference (i.e. $V_{IC_SET}-V_{IC_FB}$) is minimized (e.g., $V_{IC_FB}=V_{IC_SET}$). In other words, the IGBT can be controlled so that the coil current ($I_C$) follows the coil-current set voltage ($V_{IC_SET}$). Thus, a gradually reduction of the coil-current set voltage ($V_{IC_SET}$) corresponds to a gradual reduction of the coil current ($I_C$) (i.e., a gradual discharge).

The coil-current feedback voltage corresponds to the output of a coil-current sensor 160. As shown in FIG. 3, the coil-current sensor (i.e. $I_C$ sensor) 160 may be coupled between the emitter terminal of the IGBT and a ground. As shown in FIG. 4 the coil-current sensor may be implemented as a resistor, $R_{SNS}$, Coil current flowing through the resistor, $R_{SNS}$, generates the coil-current feedback voltage ($V_{IC_FB}$) that can be coupled to (i.e. fed back to) an inverting input of the error amplifier 430 for comparison with the coil-current set voltage ($V_{IC_SET}$) at an non-inverting input of the error (i.e., differential) amplifier 430.

The coil-current set voltage ($V_{IC_SET}$) corresponds to a voltage generated across a coil-current set resistor ($R_{IC_SET}$) 415 by a current flowing through $R_{IC_SET}$ to ground. Without any adjustment, this voltage is set by a current ($I_S$) from a current source 440 in series with $R_{IC_SET}$. The coil-current set voltage ($V_{IC_SET}$) can be adjusted by adjusting the current through the coil-current set resistor. For this adjusting the current-control circuit 300 includes two voltage-controlled current sources. Each of the two voltage-controlled current sources includes an amplifier that, based on a comparison between a received voltage to a reference level, controls a transistor to conduct a current.

A first voltage-controlled current source (i.e., first VCCS) 410 is coupled in parallel with $R_{IC_SET}$. As a result, the current conducted by the first VCCS 410 diverts (i.e., shunts, sinks, shorts, etc.) a portion of $I_S$ away from $R_{IC_SET}$, thereby reducing the voltage $V_{IC_SET}$ (i.e., reducing $I_C$). As shown in FIG. 4, the input voltage to the first VCCS 410 is a ramp signal (e.g., from a ramp generator 700—not shown). As the ramp signal ($V_{RAMP}$) gradually increases from a reference level (e.g., ground), a first amplifier 411 controls a first transistor 412 to gradually conduct more current. The increasing conduction of the first transistor 412 diverts an increasing portion of $I_S$ from $R_{IC_SET}$, thereby gradually reducing the coil-current set voltage ($V_{IC_SET}$). Accordingly, an SSD profile corresponds to the ramp signal created by the ramp generator 700.

An SSD period may begin when a ramp signal exceeds a reference level (e.g., ground) at the first amplifier 411 and an SSD profile may change in time as the ramp signal changes in time; however, while the ramp signal may have a positive slope, the SSD profile can have a negative slope.

A second voltage-controlled current source (i.e., second VCCS) 420 is coupled in parallel with the current source 440 supplying current to $R_{IC_SET}$. As a result, a current (i.e. a limiter current, $I_{LIM}$) 425 supplied by the second VCCS 420 contributes (i.e. sources, supplies, etc.) the limiter current 425 to $R_{IC_SET}$, thereby increasing the voltage $V_{IC_SET}$ (i.e., increasing $I_C$). The second VCCS is in a feedback loop with the collector terminal of the IGBT and receives a monitored collector voltage ($V_{C_MON}$) from an attenuator 405, which is configured to decreases the collector voltage ($V_C$) by a factor (i.e. a/b). The monitored collector voltage ($V_{C_MON}$) (i.e., the attenuated collector voltage) corresponds to the kickback voltage of the ignition coil 140. When the monitored collector voltage exceeds a reference voltage ($V_{REF}$) 450, a second amplifier 421 controls a second transistor 422 to gradually conduct more current. The increasing limiter current, $I_{LIM}$, of the second transistor 422 adds to the current, $I_S$, thereby increasing the coil-current set voltage ($V_{IC_SET}$). The second VCCS 420 and the first VCCS 410 can operate together to limit a kickback voltage during a soft shutdown.

Figure 5:
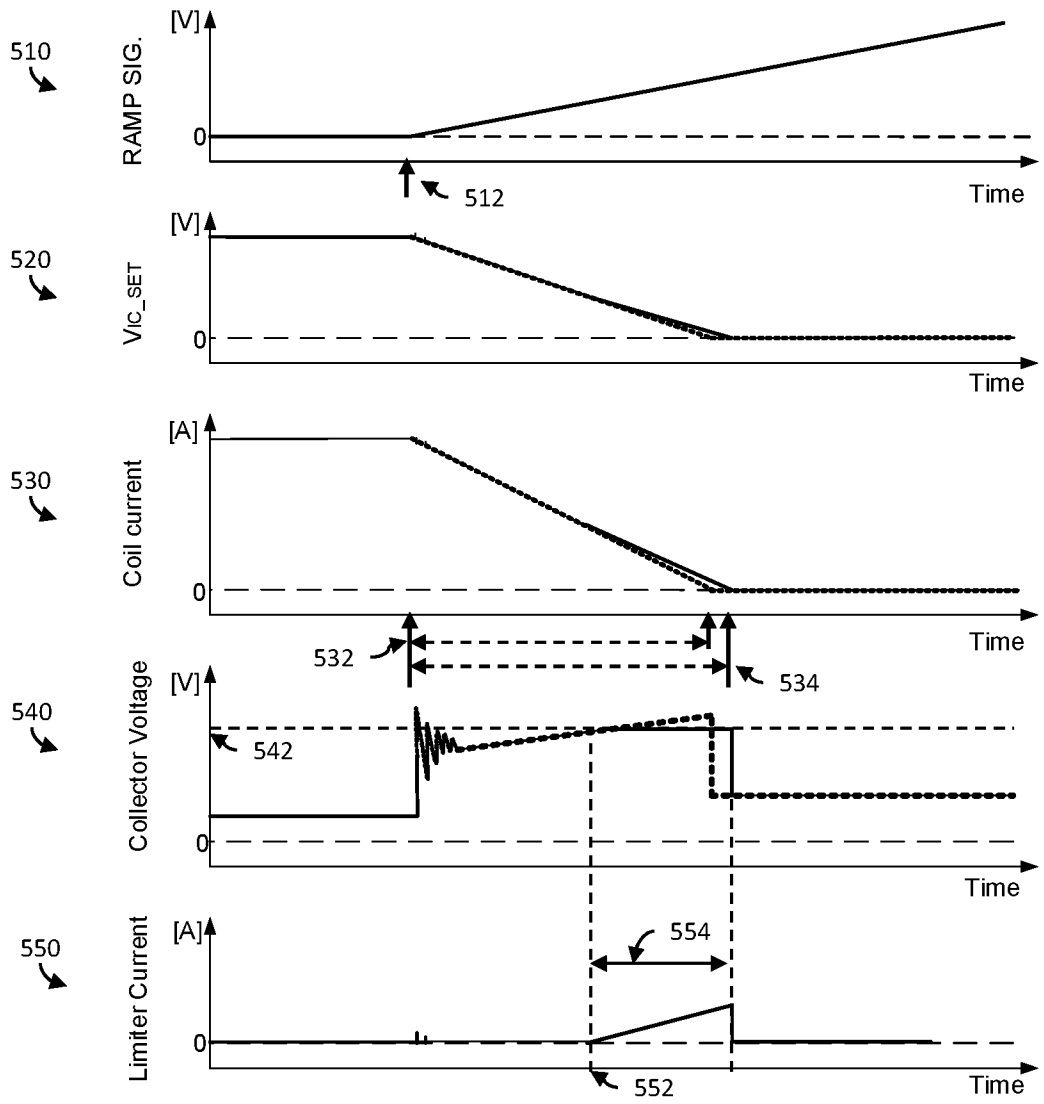
FIG. 5 are time-based graphs of signals associated with the kickback-limited soft-shutdown circuit in FIG. 4.

FIG. 5 are time-based graphs of example signals associated with (solid line) and without (dotted line) a kickback-limited soft shutdown. The example signals are all plotted versus the same time period/scale. The example signals include ramp signal 510 (i.e., $V_{RAMP}$), a coil-current set voltage 520 (i.e., $V_{IC_SET}$), a coil current 530 (i.e., $I_C$), a monitored collector voltage 540 (i.e., $V_{C_MON}$), and a limiter current 550 (i.e., $I_{LIM}$), as described in the discussion corresponding to FIG. 4. A ramp signal starts at a beginning time 512 of an SSD period and rises linearly at a ramp rate (i.e., at a slope). In response, the coil-current set voltage 520 and the coil current 530 decrease linearly according to the ramp rate (i.e., at an inverse slope). A non-zero monitored collector voltage 540 (i.e., corresponding to the kickback voltage) is generated by the changing coil current. At a time 552 the monitored collector voltage exceeds a predetermined threshold voltage level 542 (e.g., $V_{REF}$). When this occurs, a limiter current ($I_{LIM}$) is generated (e.g., by the second VCCS 420) to counter act the excess voltage (i.e., $V_{IC_MON}-V_{REF}$). The limiter current increases the coil-current set voltage 520 and the coil current 530 based on the excess voltage. In other words, the slope at which the coil-current set voltage 520 and the coil current 530 are decreasing is reduced at the time 552. Reducing the rate of change of the coil current reduces the collector voltage (i.e. corresponding to the kickback voltage). As a result, the collector voltage, and likewise the kickback voltage, can be limited at a voltage-limit threshold 542 instead of continuing to grow, as shown in the dotted line. Additionally, the SSD period with limited kickback 534 is longer than the SSD period without limited kickback 532.

The limiter current 550 is non-zero for the period 554 in which monitored collector voltage 540 exceeds the voltage limit 542 (i.e., $V_{REF}$). Accordingly, the kickback voltage limiter 200 may not affect a soft shutdown unless it generates a large kickback voltage. As a result, the current-control circuit 300 with a kickback voltage limiter 200 can be used in applications that may or may not expect high kickback voltages.

Figure 6:
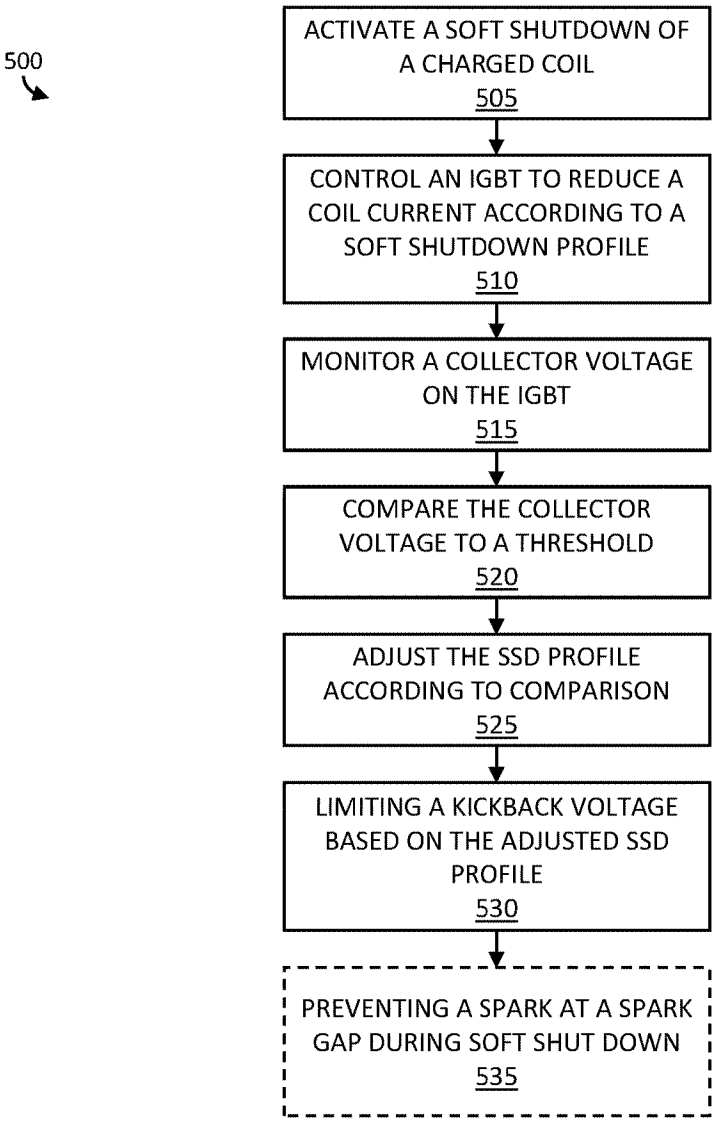
FIG. 6 is a flowchart of the method for discharging a coil according to an implementation of the present disclosure.

FIG. 6 is a flowchart of a method for limiting a kickback voltage during a soft shutdown of a coil. The method 500 includes activating 505 a soft shutdown of a charged coil. A charged coil is a coil carrying a current (e.g., a current at the current limit of the coil). The activating may include receiving an SSD trigger signal at a ramp generator to cause the ramp generator to begin transmitting a ramp signal to a current-control circuit. The SSD trigger signal may be in response to a condition detected in the ignition system. For example, an expiration of over dwell period without a spark may trigger an SSD. In another example, a temperature of a coil or an IGBT exceeding a threshold may trigger an SSD.

The method further includes controlling 510 an IGBT to reduce a coil current according to an SSD profile. The SSD profile includes a voltage that decreases at a rate (i.e., volts/sec) corresponding to the ramp signal. For example, the rate (i.e., slope) of the SSD may be the inverse of a rate (i.e. slope) of the ramp signal. The SSD profile may be applied to the gate of the IGBT so that the coil current through the IGBT (i.e., flowing between collector and emitter) is gradually reduced according to the rate of the SSD.

The method further includes monitoring 515 a voltage at a collector terminal (i.e., the collector voltage) of the IGBT. The collector voltage of the IGBT is connected to the primary coil and therefore corresponds to a kickback voltage created by a changing current through the primary coil. The monitoring may include attenuating the collector voltage.

The method further includes comparing 520 the monitored collector voltage to a threshold (i.e., a limit) and based on the comparison, adjusting 525 the SSD profile. For example, upon determining the monitored voltage meets or exceed the limit the SSD profile may be adjusted. For example, the adjustment may include reducing the rate (i.e., slope) of the SSD.

The method further includes limiting 530 the kickback voltage based on the adjusted SSD. A redacting in the rate (i.e., slope) of the SSD corresponds to a reduction in a rate of change of the coil current, which reduces the kickback voltage. Limiting the kickback voltage include limiting a secondary voltage to a voltage below a breakdown voltage of a spark gap. Thus, the method for limiting a kickback voltage during a soft shutdown of a coil may include preventing 535 a spark at a spark gap during a soft shutdown.

Figure 7:
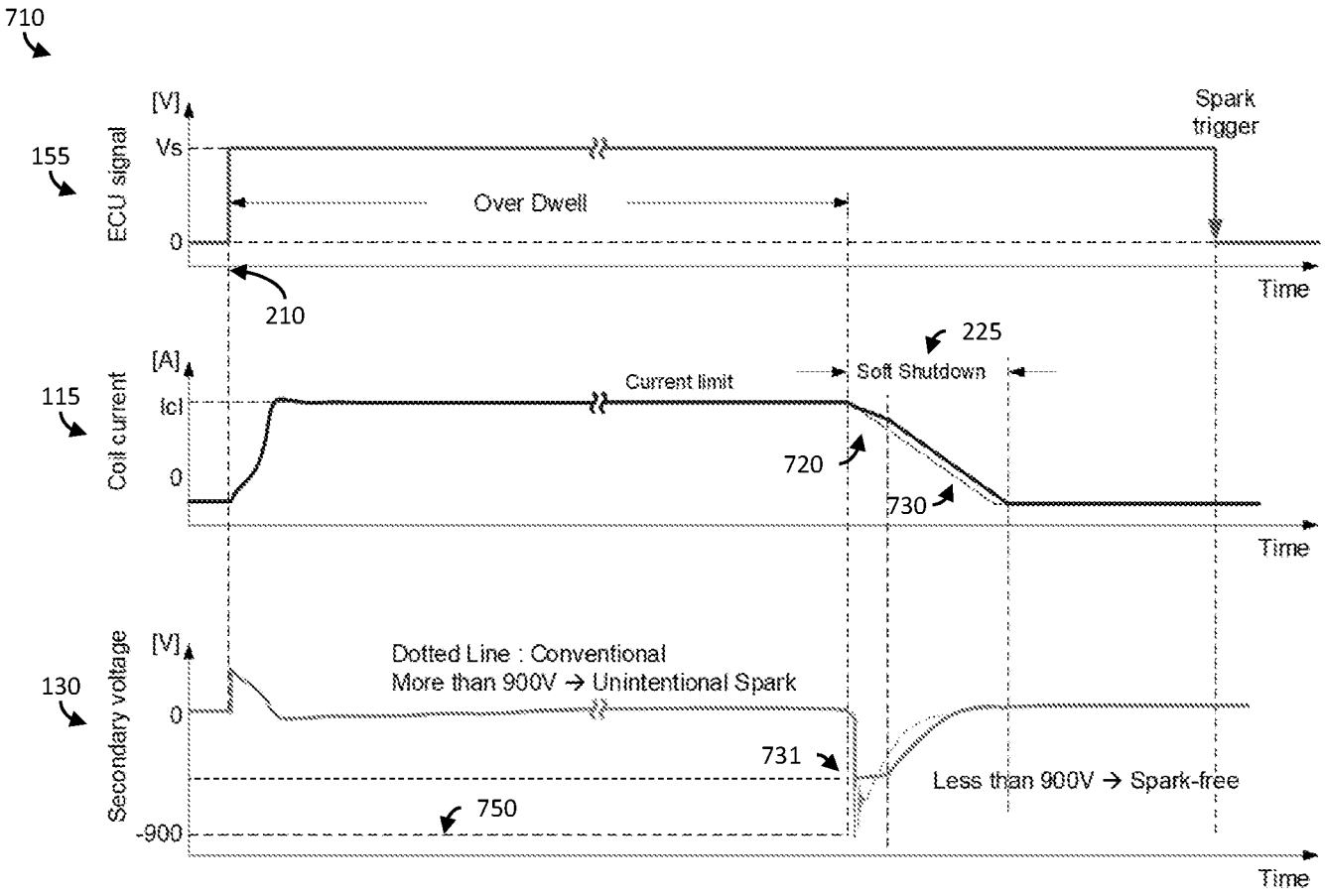
FIG. 7 are time-based graphs of signals corresponding to the ignition system in FIG. 1 with and without kickback-limited soft-shutdown.

FIG. 7 includes graphs of signals corresponding to the ignition system 100 of FIG. 1. The example signals are all plotted versus the same time period/scale. The example signals are the same as shown and described in FIG. 2 and include an ECU signal 155, a coil current 115, and a secondary (coil) voltage 130. The signals of FIG. 7, however, illustrate the effect of a kickback-limited soft shutdown (i.e., shown as solid lines) as compared to a soft shutdown without kickback limiting (i.e., shown as dotted lines). During the soft shutdown period of the kickback-limited SSD, the secondary voltage 130 is limited to a voltage 731 that is less than a spark voltage 750 (i.e., a voltage sufficient to breakdown the spark gap, such as 900 volts). The limiting is a result of an adjustment to the soft shutdown profile. While the secondary voltage is limited, the rate at which the coil current decreases (i.e., the slope) is reduced. After the coil is partially discharged, the kickback voltage reduces to a value at which limiting is no longer necessary. Accordingly, for the remainder of the soft shutdown period, the rate at which the coil current decreases (i.e., the slope) is no longer reduced. In other words, a soft shutdown with kickback limiting may include a limited portion 720 during which the profile slope is less than an unlimited portion 730. The limited portion 720 may occur at the beginning of the soft shutdown period when the coil current (i.e., the coil charge) is highest.

The current-control circuit 300 having a kickback voltage limiter 200 limits voltage spikes due to abrupt changes in the coil current. As mention previously, ramp signal from the ramp generator 700 configures the current-control circuit 300 to change the coil current. Accordingly, abrupt changes in the ramp signal can lead to voltage spikes. Thus, for a current-control circuit without kickback limiting, the ramp generator must be configured to generate a ramp signal with no abrupt changes or with carefully controlled (e.g., relatively small) abrupt changes. The disclosed current-control circuit 300 with a kickback voltage limiter 200 eliminates or reduces these design constraints and facilitates the use of a ramp generator configured to generate a ramp signal with abrupt changes. This may simplify a circuit design for the ramp generator 700. The simplification may be advantageous because it can lead to a simpler (e.g., a reduced number of devices) ramp generator. Because the simpler ramp generator may be smaller, it may be possible to include it as part of (i.e. on the same semiconductor die as) the current-control circuit 300.

Figure 8:
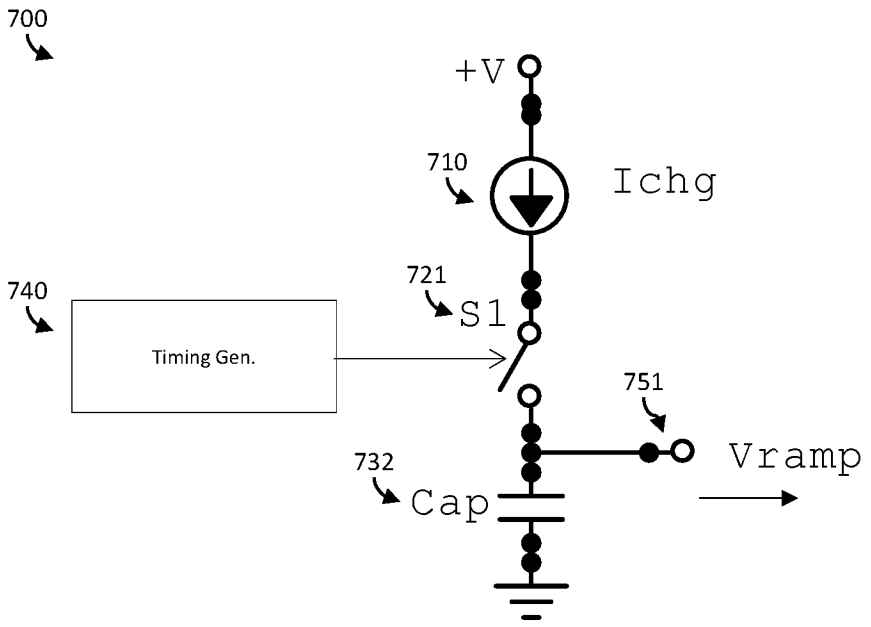
FIG. 8 is a schematic of a ramp generator circuit suitable for use with the kickback-limited soft-shutdown circuit of FIG. 4.

FIG. 8 is a schematic of a simplified ramp generator circuit implementation (i.e. ramp generator) configured to generate a ramp signal with abrupt changes. Despite the abrupt changes, the ramp signal is suitable for use with the ignition 400 system because of the kickback voltage limiter 200.

The ramp generator 700 includes a current source 710 configured to generate a current, Ichg. The current source can be coupled or decoupled from a storage device (e.g., a capacitor) 732 by a switch 721, S1, (e.g., a transistor). The switch 721 can be configured by signals from a timing generator 740 (e.g., clock circuit) to control the state (i.e. ON/OFF) of the switch 721. When a timing signal form the timing generator 740 configures the switch to be repeated turned ON and OFF (e.g., pulsed ON) a voltage ($V_{RAMP}$) at an output 751 of the ramp generator 700 approximates a ramp signal (i.e., is a pseudo ramp wave).

Figure 9:
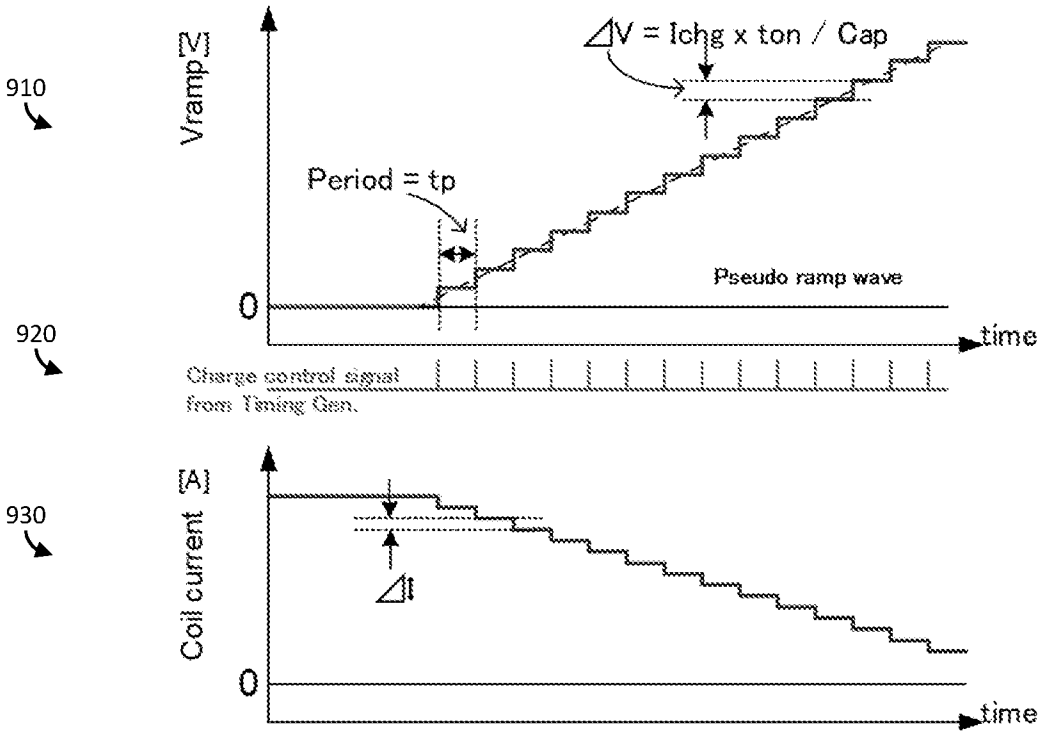
FIG. 9 are time-based graphs of example signals corresponding to the ramp generator circuit of FIG. 8.

FIG. 9 are time-based graphs of example signals corresponding to the ramp generator circuit of FIG. 8. The example signals include a ramp signal 910, a timing signal 920. The example signals also include a coil current 930 that could be created by the ramp signal using a current-control circuit 300 in an ignition system 100, such as shown in FIG. 1. The ramp signal ($V_{RAMP}$) is an approximation of a ramp wave (i.e., a pseudo ramp wave). The ramp signal includes stair like discontinuities. The discontinuities correspond in time to a charge a control signal from the timing generator 740. For example, the discontinuities may be separated in time by a period (tp). Each discontinuity may have an amplitude (ΔV) that corresponds to the time the switch is ON, the charge current (Ichrg) and the capacitance (Cap) of the capacitor (e.g., ΔV=(Ichg·ton)/Cap). Each discontinuity in the ramp signal 910 can correspond to a discontinuity in in the coil current based on the operation of the current-control circuit as described previously. At each discontinuity, the current may change (ΔI) almost instantly. Accordingly, even the small discontinuity may result in a large collector voltage corresponding to a kickback voltage of a charged coil.

Figure 10:
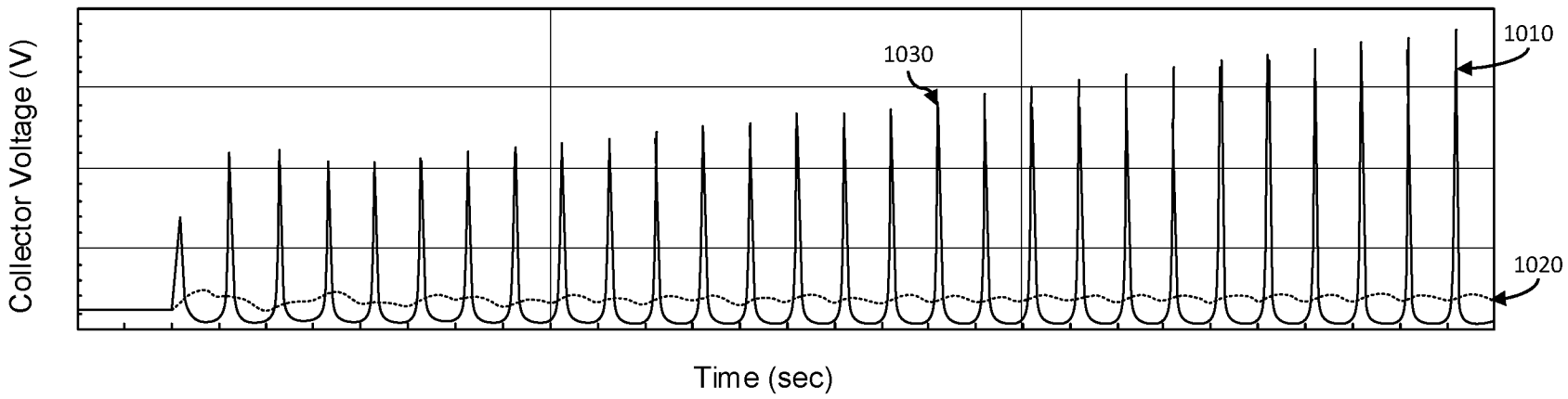
FIG. 10 are time-based graphs of signals associated with ramp generator circuit of FIG. 8 when used with and without the kickback-limited soft-shutdown circuit.

FIG. 10 is a time-based graphs of the collector voltage ($V_C$) of an IGBT 170 in an ignition system, such as shown in FIG. 3. A first collector voltage 1010 results from an ignition circuit having current-control circuit 300 without kickback voltage limiting (i.e., without the kickback voltage limiter 200 of FIG. 3). The first collector voltage 1010 includes voltage spikes at each discontinuity of the pseudo ramp wave (e.g., voltage spike 1030). A second collector voltage 1020 results from an ignition circuit having current-control circuit 300 with kickback voltage limiting (i.e., without the kickback voltage limiter 200 of FIG. 3). The second collector voltage 1020 is made more constant by the kickback limiting. The second collector voltage 1020 lacks the voltage spikes of the first collector. The second collector voltage 1020 may still include a ripple profile that corresponds to the discontinuities, but the ripple is not significant enough to affect an SSD profile.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

The invention claimed is:

1. An ignition system, comprising:

an ignition coil conducting a coil current;

a switching device coupled to the ignition coil at a collector terminal and controllable at a gate terminal to adjust the coil current; and a current-control circuit configured to output a signal at the gate terminal to reduce the coil current according to a soft shutdown profile, the current-control circuit including a kickback voltage limiter that is configured to monitor a collector voltage at the collector terminal and to adjust the soft shutdown profile according to the collector voltage to limit a kickback voltage.

2. The ignition system according to claim 1, wherein the current-control circuit is configured to attenuate the collector voltage and to compare the attenuated collector voltage to a threshold voltage.

3. The ignition system according to claim 2, wherein the current-control circuit is configured to reduce a slope of the soft shutdown profile when the attenuated collector voltage is at or above the threshold voltage.

4. The ignition system according to claim 2, wherein the current-control circuit includes a voltage-controlled current source that is configured to generate a current corresponding to a voltage corresponding to a difference between the attenuated collector voltage and the threshold voltage.

5. The ignition system according to claim 1, wherein the ignition coil includes a primary coil inductively coupled to a secondary coil in series with a spark gap and the kickback voltage is a voltage at the spark gap.

6. The ignition system according to claim 5, wherein the kickback voltage is limited to a voltage below a spark voltage of the spark gap.

7. The ignition system according to claim 1, wherein the switching device is an insulated gate bipolar transistor.

8. The ignition system according to claim 1, wherein the current-control circuit includes a hard shutdown circuit configured to reduce the coil current abruptly according to a hard shutdown profile, the hard shutdown profile unaffected by the kickback voltage limiter.

9. The ignition system according to claim 1, wherein the current-control circuit further includes:

a coil-current sensor configured to monitor the coil current;

a hard shutdown circuit configured to reduce the coil current abruptly according to a hard shut down profile; and a soft shutdown circuit configured to reduce the coil current at a rate determined by the soft shutdown profile.

10. The ignition system according to claim 9, wherein the soft shutdown circuit is configured to receive a ramp signal from a ramp generator, a start of a soft shutdown period and a rate of the soft shutdown profile determined by the ramp signal.

11. A method for shutting down a coil current in a coil, the method comprising:

controlling a switching device to reduce the coil current in the coil according to a soft shutdown profile;

monitoring a voltage at a terminal of the switching device, the terminal directly coupled to the coil;

comparing the voltage to a voltage-limit threshold; and adjusting the soft shutdown profile according to the voltage comparison to limit a kickback voltage generated by the coil.

12. The method according to claim 11, wherein the adjusting the soft shutdown profile according to the voltage comparison to limit the kickback voltage generated by the coil comprises:

determining that the voltage exceeds the voltage-limit threshold; and decreasing a rate at which the coil current is reduced, the rate decreased by an amount corresponding to the amount that the voltage exceeds the voltage-limit threshold.

13. The method according to claim 11, further comprising:

triggering a soft shutdown after an expiration of an over dwell period.

14. The method according to claim 11, wherein the switching device is an insulated gate bipolar transistor (IGBT).

15. The method according to claim 14, wherein the terminal of the switching device is a collector terminal of the IGBT, the collector terminal coupled to the coil.

16. The method according to claim 14, wherein the adjusting the soft shutdown profile according to the voltage comparison to limit the kickback voltage generated by the coil comprises:

increasing a voltage at a gate terminal of the IGBT by an amount corresponding to a difference between the voltage and a voltage-limit threshold.

17. The method according to claim 11 further comprising:

preventing a spark at a spark gap that is inductively coupled to the coil.

18. A current-control circuit comprising:

a coil-current sensor configured to sense a coil current flowing through a switching device that is in series with a coil;

a kickback voltage limiter configured to sense a collector voltage at a terminal of the switching device that is directly coupled to the coil and to compare the collector voltage to a voltage-limit threshold; and a soft shutdown circuit configured to receive a ramp signal and to reduce the coil current based on the ramp signal and the sensed coil current, the soft shutdown circuit further configured to decrease a rate at which the coil current is reduced when the collector voltage exceeds the voltage-limit threshold.

19. The current-control circuit according to claim 18, further comprising:

a hard shutdown circuit that configured to reduce the coil current abruptly, the hard shutdown circuit unaffected by the kickback voltage limiter.

* * * * *